United States Patent [19]

Koenig et al.

[11] Patent Number: 4,903,278

[45] Date of Patent: Feb. 20, 1990

[54] ELECTRODE HOLDING AND POSITIONING

[75] Inventors: Heribert Koenig, Duisburg; Heinz Stark, Essen, both of Fed. Rep. of Germany

[73] Assignee: Mannesmann AG, Duesseldorf, Fed. Rep. of Germany

[21] Appl. No.: 265,571

[22] Filed: Nov. 1, 1988

[30] Foreign Application Priority Data

Nov. 2, 1987 [DE] Fed. Rep. of Germany ..... 3737488

[51] Int. Cl.[4] ..... H05B 7/09; H05B 7/10

[52] U.S. Cl. ..... 373/97; 373/105

[58] Field of Search ..... 373/105, 97, 89

[56] References Cited

U.S. PATENT DOCUMENTS

Re. 24,821 5/1960 Stauffer ..... 373/105

1,679,284 7/1928 Westly ..... 373/89

*Primary Examiner*—Roy N. Envall, Jr.

*Attorney, Agent, or Firm*—Ralf H. Siegemund

[57] ABSTRACT

A consumable electrode is positioned in a furnace under utilization of radially outwardly projecting ribs, at least one wheel with projection engages one of the longitudinal ribs and provides a deformation thereof in terms of indentation and thereby is and remains briefly in engagement with the rib such that the wheel with and through its projection holds and advances that electrode. The wheel has prongs, serrations or teeth and preferably cooperates with a counterwheel on the other side of the rib.

14 Claims, 2 Drawing Sheets

FIG. 1
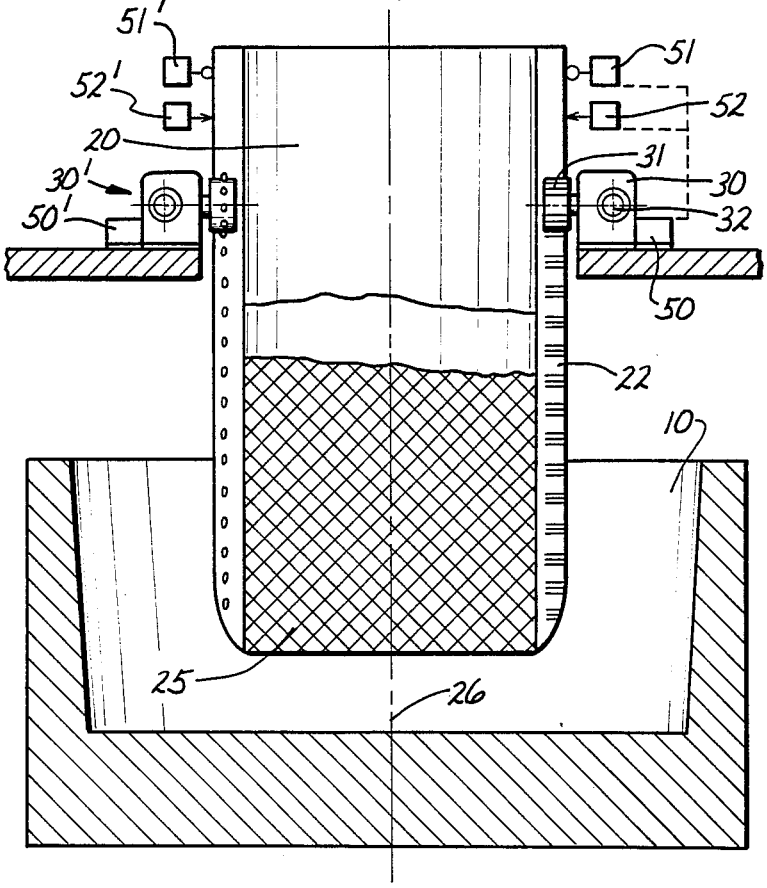
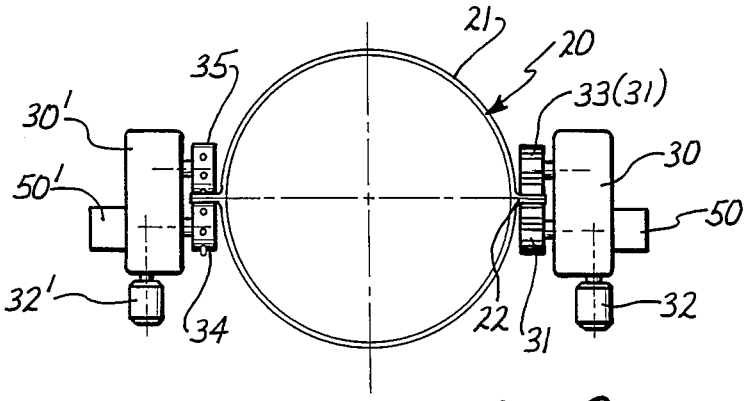
FIG. 2

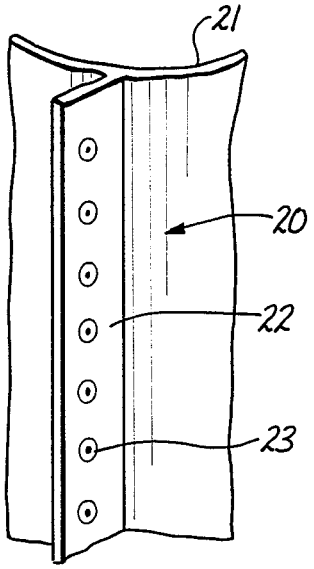
FIG. 4
FIG. 3
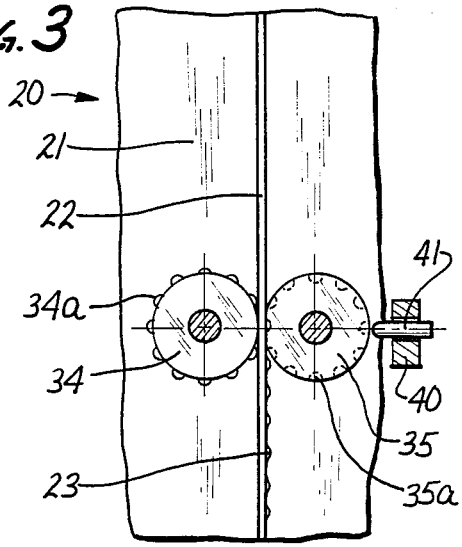
FIG. 5
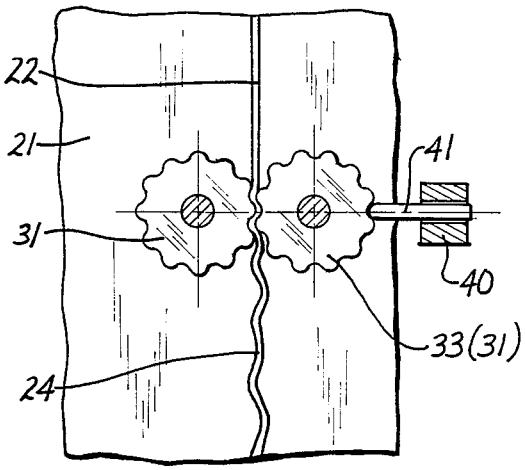
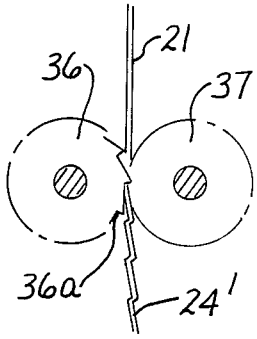
FIG. 6

ELECTRODE HOLDING AND POSITIONING

BACKGROUND OF THE INVENTION

The present application relates to a method and device for positioning of a self-baking filler electrode in electrical reduction and arc furnaces, particularly under utilization of electrodes having a jacket with radially outwardly extending longitudinal ribs or fins provided for engagement with positioning structure.

Electrothermic smelting and melting furnaces particularly electrically operated reduction furnaces with or without arc type heating usually employ self baking filler electrodes of the so called Soederberg type. These filling electrodes are comprised of a thin, shaping sheet metal jacket filled with the consumable material. These electrodes are very sensitive against radial impacts, pressures or the like as they may occur; "radial" of course to be understood in relation to the axis of the electrode. Upon installing such electrodes they require usually a device for placing the electrode tip or end into a particular elevational position which is to be maintained and necessary or advantageous for metallurgical procedure. Repositioning the electrode is a continuous operation in order to offset the dimensional variations as the electrode is consumed.

German Pat. No. 83 14 30 discloses such an electrode feeding structure with a gear transmission of the rack and pinion drive variety. Projections, generally speaking, are movable parallel to the axis of the electrode and engage indents in the electrode jacket. The indents could actually be provided for during operation and synchronously with the feeding operation and by means of a structure which is separated from the electrode feeding device.

On holding as well as during feeding of the electrodes radial forces will therefore be exerted on the jacket. These are necessary in order to prevent uncontrolled slide through of the electrode. Controlling these forces and the radial forces for providing the indents is actually quite difficult. Swiss Pat. No. 323760 discloses a similar electrode feeding device of this type which requires a prefabricated groove in the electrode to receive a rack to be moved by a pinion.

German Pat. No. 33 04 099 discloses structure wherein a clamping device engages radially the jacket and here outwardly extending longitudinal ribs. This electrode drive device is disadvantaged by the fact that they are technically of rather complicated construction for moving the electrode one needs twice as many clamping structures. The duplication in number is required since only half of the clamping brackets will engage the ribs for a certain period of time and the have to be released and returned to re-engage the structure. During that period of course the electrode is not permitted to slide and that is the reason a second set of clamping brackets is needed.

In addition the clamping elements have to be pressure biased for emergency cases for example in case of an electric current failure, a pressure drop or the like; the electrodes must be held firmly and must not be permitted to move in an uncontrolled fashion. The emergency arrangement includes spring operated clamping brackets which means that higher release pressure is required for disengagement to overcome the spring bias.

DESCRIPTION OF THE INVENTION

It is an object of the present invention to provide a simple reliable new and improved method and equipment for stepless i.e. continuously advancing electrodes of the type mentioned above and which shows little expenditure and operates with a simple, constructed positioning structure in order to obtain the desired goal.

In accordance with the preferred embodiment of the present invention, it is suggested that the positining device itself deforms the above mentioned longitudinal ribs particularly as the electrode is lowered such that on vertical movement of the electrode definite engagement obtains between the positioning device and the deformed longitudinal ribs as they are being deformed and in a form and shape matching relationship. The ribs are preferably provided by the positioning device with cuplike indents or with a wavy or sawtooth corrugating pattern. The positioning device itself is preferably provided with wheellike elements, one wheel at least being of a configuration that provides the above mentioned shaping and is being driven for vertically moving the electrodes. Hence it can be seen that through positive contour matching engagement the electrodes are positioned and movable for continuous displacement in up and/or down directions thus permitting lowering as well as lifting.

In a typical case one may use three positioning devices of this kind cooperating with three grooves and being provided in the same level. This then permits an exact fixing and establishing of the position of the electrode tip. Hence not only is axial centering provided but the electrode tip is exactly controlled with regards to its position. The electrode will be adjusted corresponding to the electrical and metallurgical requirements, not just in a particular level but in particular relation to the molten material. This obtains in addition to axially positioning the electrodes to be precisely in the center of the furnace which is also a vertical axis.

For deforming the longitudinal ribs in the electrode one needs at least one shaping wheellike element. This wheellike element is preferably constructed similarly to a gear. The counterwheel may also be provided as a gear or it may be deformable so that the longitudinal ribs are just deformed by the teeth of the principal drive wheel. In another configuration as stated the wheel is provided with thornlike peaks and extensions which configuration is of advantage as the deforming work to be exerted upon the longitudinal ribs is very low. In addition an exact positioning and holding of the electrode is indeed provided through the peaks which engage potlike or cuplike indents of the longitudinal rib. In this example the counterwheel should have bores which permits the peaks of the other wheel to push sheet material into these bores.

All positioning wheels are preferably driven. The wheellike elements of the positioning device permit easy adaptation towards an emergency equipment. The emergency equipment may include a locking element such as a plunger for engaging one of the wheels and stopping it. This wheel then holds the electrode. These elements may either be operated continuously e.g. during lowering of the electrode or only in the case of energy dropout. On the other hand the plunger may be used, in addition, and during operation to constitute a break. In all of these cases it can be seen that the emergency holding equipment is simple and effective. Further included in the safety equipment is the measuring transducer arranged at the electrode in which response to the lowering speed of the electrodes. Should that speed exceed a predetermined limit then the emergency equipment may be triggered.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 illustrates a cross sectional view through a furnace with an electrode positioning device improved in accordance with the preferred embodiment of the present invention for practicing the best mode thereof;

FIG. 2 is the top view of positioning device used in FIG. 1;

FIG. 3 is an illustration of a drive wheel being part of the positioning device and having pointlike projections or thorns;

FIG. 4 illustrates somewhat schematically a perspective view of a longitudinal rib for electrode deformed by structure shown in FIG. 3;

FIG. 5 is a view similar to FIG. 3 but shows deformation through gearlike wheels; and FIG. 6 is also a view similar to FIG. 3 but shows a sawtooth wheel.

Proceeding now to the detailed description of the drawings, FIG. 1 illustrates a furnace 10 for smelting or melting into which projects an electrode 20. The electrode includes a jacket 21 with two (or more) ribs 22 projecting in radial direction. Reference numeral 25 refers to the filler material which is the basically consumable item for the self baking electrode. Reference numeral 30 generally refers to one of the positioning devices and 30' is the second one. In this case the devices 30 and 30' are disposed diametrically in relation to each other and across the axis 26 of the electrode which is also the axis of the furnace 10. The positioning structures 30 and 30' are connected respectively to controllers 50 and 50' which include pickup transducers 51 and 51' monitoring the passage of the electrode 10 in up or down direction while transducers 52 and 52' establish the distance of the electrodes from the respective instrument and, thereby, monitor the horizontal position, meaning that these devices 52 and 52' monitor any deviation in electrode position from coaxial one as far as the furnace axis 26 is concerned.

As far as FIG. 2 is concerned, but also in FIG. 1 the two positioning devices are shown to be of different construction. In reality one will of course use one and the same kind of positioning devices for all ribs but for purposes of illustrating different kinds have been illustrated, meaning that FIGS. 1 and 2 can also be understood to show different embodiments to the left and to the right of what is in effect a vertical plane.

The right hand positioning device 30 is driven by a motor 32. This positioning device includes a first drive wheel 31 and a counterwheel 33. Both of them are driven. In other words, 30 includes a branching transmission coupling both wheels 31 and 33 to motor 32. These two wheels 31, 33 are in fact gears. Their engagement is shown particularly in FIG. 5. The two gears 31 and 33 are positioned in relation to each other just as gears are with the teeth in one wheel projecting into indentations of the other wheel. In this case now the longitudinal rib 22 is interposed and it can be seen specifically that at first in FIG. 5 the rib 22 is smooth and straight but on engagement with the gears 31 and 33 corrugations 24 are impressed into the rib resulting in a corrugation pattern. This pattern in turn permits the two wheels 31 and 33 to grip firmly and without slippage into the rib 21.

As shown also in the right hand portion of FIG. 5 an emergency structure 40 is provided which includes a pin plunger or bolt 41. In the case of power failure or the like pin or plunger 41 will be pushed into the closest groove or indent of the gear 33; that is actually a position shown in FIG. 5. Pushing may be carried out for example by means of spring bias or the like. This plunger 41 is of course retracted e.g. upon normal elective current flow, while the spring force will propel plunger 41 forward and thereby stopping the wheel 33 which in turn will correspondingly hold wheel 31 with the rib 22 with indents 24 interposed. The motor 32 e.g. either has dropped out because of power failure or is separately turn-off or will just stall. In any event in such an emergency situation the drive wheels 31 and 33 will hold the rib and the electrode and prevent slipping through.

The positioning device 30' on the left hand side of the FIG. 1 and FIG. 2 shows another version for positioning which includes a wheel 34 (see also FIG. 3) which has along its periphery thornlike projections, points or the like **34*a*. This wheel cooperates with a counterwheel 35 having potlike indentations or recesses 35*a*. In this case the longitudinal rib 22 of electrode jacket 21 is deformed by the wheel 34 in that the prongs, points, thorns or the like 34*a* each push an indent into the rib on each contact. The pockets 35*a* are disposed on the other side to receive the pushed in material of the rib 22**.

As a consequence of the arrangement and construction shown in FIG. 3 and 4 potlike indents 23 are produced which of course are and remain for certain short period of time an engagement with the two wheels 34 and 35. As a consequence also here positive engagement between this drive mechanism and the originally smooth rib 22 obtains.

In addition one can see from FIG. 3 that there is also a plunger 41 which in this case selectively engage when propelled forward one of the indents 35 to thereby prevent further rotation of the two wheels.

FIG. 6 shows the rib 21 being deformed by a wheel 36 with a sawtooth **36*a* periphery. The wheel 37** on the other side has a highly ductile or yielding surface.

The invention is not limited to the embodiments described above but all changes and modifications thereof, not constituting departures from the spirit and scope of the invention, are intended to be included.

We claim:

1. Apparatus for positioning a consumable electrode in a furnace, the electrode having a jacket with at least two radially outwardly projecting longitudinal ribs, a positioning device comprising:

at least one wheel with projections engaging one of the longitudinal ribs and providing a deformation thereof in terms of indentation which thereby is and remains briefly in engagement with said wheel such that the wheel with and through its projection holds and advances that electrode.

2. Apparatus as in claim 1 there being a counter wheel cooperating with said wheel having the projections.

3. Apparatus as in claim 2 said wheel having thornlike projections, said counterwheel having peripheral bores.

4. Apparatus as in claim 2 said wheel and counterwheel both being of gear configuration to provide corrugationlike deformations.

5. Apparatus as in claim 2 said wheel having a sawtooth contour as projections, said counterwheel having a smooth surface made of a ductile material.

6. Apparatus as in claim 2 including an emergency equipment for selective engagement of an indent in said counterwheel.

7. Apparatus as in claim 6, the emergency equipment including a plunger to provide for such selective engagement.

8. Apparatus as in claim 1 including means for tracking progress of said electrode to control progression thereof.

9. Apparatus as in claim 1 wherein the engagement provides for regularly spaced deformations.

10. Apparatus as in claim 1 including means for tracking position of said electrode to control its progression.

11. Apparatus for positioning a consumable electrode in a furnace, the electrode having a jacket with at least two radially outwardly projecting longitudinal ribs, a positioning device comprising:

two wheels each with projections engaging the longitudinal ribs and providing deformations thereof in terms of indentations which thereby are and remain briefly in engagement with said wheels such that the wheels with and through its projection holds and advances that electrode; and counter wheels respectively cooperating with said wheels having the projections.

12. Apparatus as in claim 11 said wheels having thornlike projections, said counterwheel having peripheral bores.

13. Apparatus as in claim 11 said wheels and counterwheel both being of gear configuration to provide corrugationlike deformations.

14. Apparatus as in claim 11 said wheels having a sawtooth contour as projections, said counterwheel having a smooth surface made of a ductile material.

* * * * *